US010852074B2

(12) United States Patent
Somhorst et al.

(10) Patent No.: US 10,852,074 B2
(45) Date of Patent: Dec. 1, 2020

(54) HEADER FOR HEAT EXCHANGER

(71) Applicant: Hanon Systems, Daejeon (KR)

(72) Inventors: Leo Somhorst, Lower Camden (GB); Petr Fabian, Studenka (CZ); Stephen Joyce, Redhill (GB); Adam Coleberd, Axminster (GB)

(73) Assignee: HANON SYSTEMS, Daejeon (KR)

( * ) Notice: Subject to any disclaimer, the term of this patent is extended or adjusted under 35 U.S.C. 154(b) by 246 days.

(21) Appl. No.: 15/155,395

(22) Filed: May 16, 2016

(65) Prior Publication Data

US 2016/0334174 A1 Nov. 17, 2016

Related U.S. Application Data

(60) Provisional application No. 62/161,964, filed on May 15, 2015.

(51) Int. Cl.
*F28F 9/02* (2006.01)

(52) U.S. Cl.
CPC ..... *F28F 9/0226* (2013.01); *F28F 2225/08* (2013.01); *F28F 2275/085* (2013.01); *F28F 2275/12* (2013.01)

(58) Field of Classification Search
CPC ..... F28F 9/0219; F28F 9/0224; F28F 9/0226; F28F 2275/08; F28F 2275/085; F28F 9/002; F28F 9/005; F16B 5/0016; F16B 5/0621; F16B 5/0635; F16B 5/0012; F16L 3/13
See application file for complete search history.

(56) References Cited

U.S. PATENT DOCUMENTS 3,793,701 A * 2/1974 Chartet ..... B21D 26/14 29/419.2
4,600,051 A * 7/1986 Wehrman ..... F28F 9/0226 165/149
4,649,628 A * 3/1987 Allemandou ..... F28F 9/0226 165/148
4,651,815 A * 3/1987 Logic ..... F28F 9/0226 165/148

(Continued)

FOREIGN PATENT DOCUMENTS

DE 2703528 A1 * 8/1978 ..... F28F 9/0226
DE 102014204272 A1 * 10/2014 ..... F28F 9/0224

(Continued)

*Primary Examiner* — Joel M Attey
*Assistant Examiner* — For K Ling
(74) *Attorney, Agent, or Firm* — Shumaker, Loop & Kendrick, LLP; James D. Miller

(57) ABSTRACT

A heat exchanger for a motor vehicle comprises a fluid reservoir having at least one continuous sidewall. A plurality of first coupling features are formed in a base of the sidewall, wherein the first coupling features are outward extending protrusions. The heat exchanger further comprises a header configured to receive a portion of the fluid reservoir therein. The header includes a mounting tab having a plurality of second coupling features and a plurality of reinforcing features alternately formed therein. Each of the second coupling features are cavities configured to receive a portion of a corresponding one of the first coupling features therein. A receiving surface of each of the second coupling features cooperates with an engaging surface of the corresponding one of the first coupling features.

13 Claims, 5 Drawing Sheets

(56) References Cited

U.S. PATENT DOCUMENTS

| | | | | | |
|---|---|---|---|---|---|
| 5,311,933 | A * | 5/1994 | Lee | F28F 9/0226 | 165/149 |
| 5,366,008 | A * | 11/1994 | Kadle | F28D 1/05366 | 165/173 |
| 2008/0105415 | A1 * | 5/2008 | Harich | F28D 1/0435 | 165/149 |
| 2011/0017742 | A1 * | 1/2011 | Sausen | B65D 11/188 | 220/324 |

FOREIGN PATENT DOCUMENTS

| | | | | |
|---|---|---|---|---|
| FR | 2499234 | A1 * | 8/1982 | F28F 9/0226 |
| FR | 2528561 | A1 * | 12/1983 | F28F 9/0226 |
| FR | 2614408 | A1 * | 10/1988 | F28F 9/0226 |
| JP | 63148094 | A * | 6/1988 | F28D 1/0535 |
| WO | 2014173909 | A1 | 10/2014 | |

* cited by examiner

HEADER FOR HEAT EXCHANGER

CROSS-REFERENCES TO RELATED APPLICATION

This application claims priority to U.S. Provisional Patent Application No. 62/161,964, filed on May 15, 2015, the disclosure of which is incorporated herein by reference in its entirety.

FIELD OF THE INVENTION

The invention relates to a heat exchanger for a motor vehicle, and more particularly, to a recessed header for coupling a fluid reservoir a heat exchanger.

BACKGROUND

Heat exchangers are generally formed of a core configured to facilitate an exchange of thermal energy with a fluid passing therethrough. A header is disposed on at least one end of the core, and provides an interface between the core and a fluid reservoir, such as a tank or manifold. One common type of header is known as a recessed header, wherein a portion of the header is recessed to receive a portion of the fluid reservoir therein.

In modern heat exchangers, an integrated means for coupling the fluid reservoir to the header is desirable, as it allows the heat exchanger to be assembled without using independent fastening means, such as bolts and clips. By using an integrated means for coupling the headers and fluid reservoirs, manufacturing costs can be substantially reduced by minimizing assembly time and eliminating unnecessary components.

However, in recent years, increased performance requirements for heat exchangers have caused existing configurations of integrated coupling means to become insufficient. For example, modern heat exchangers operate at increased internal pressures. During operation at the increased internal pressures, the interface between the header and the fluid reservoir may warp or fracture as a result of pressure induced stresses, causing a failure of the heat exchanger.

In a common heat exchanger configuration, a fluid reservoir is coupled to a header by inserting a portion of the fluid reservoir into the header, and subsequently securing the fluid reservoir by deforming a plurality of tabs of the header over the inserted portion of the fluid reservoir. However, this configuration is prone to failure under the increased pressure conditions of modern heat exchangers. For example, as the pressure within the fluid reservoir increases, the fluid reservoir is biased apart from the header, and the inserted portion of the fluid reservoir applies a bending moment to the tabs of the header. The bending moment forces the tabs of the header outward, allowing the fluid reservoir to separate from the header. Further, deforming the tabs of the header creates residual stress concentrations in the header. Upon application of the increased pressures, the areas of the residual stress concentrations are prone to failure.

Additionally, modern heat exchangers are commonly integrated into rigid components of the vehicle. By rigidly mounting the heat exchanger within the vehicle, the heat exchanger is more susceptible to harmful vehicle vibrations. Accordingly, increased vibration of the heat exchanger further increases stresses in the interface between the header and the fluid reservoir.

Accordingly, there exists a need in the art for an improved means of coupling a fluid reservoir to a header of a heat exchanger, wherein the coupling means is integral to the heat exchanger assembly.

SUMMARY OF THE INVENTION

In concordance with the instant disclosure, an improved means of coupling a fluid reservoir to a header of a heat exchanger assembly, wherein the coupling means is integral in the heat exchanger assembly is surprisingly discovered.

In a first embodiment, a heat exchanger for a motor vehicle comprises a fluid reservoir having at least one continuous sidewall. A plurality of first coupling features are formed in a base of the sidewall, wherein the first coupling features are outward extending protrusions. The heat exchanger further comprises a header configured to receive a portion of the fluid reservoir therein. The header includes a mounting tab having a plurality of second coupling features and a plurality of reinforcing features alternately formed therein. Each of the second coupling features are cavities configured to receive a portion of a corresponding one of the first coupling features therein. A receiving surface of each of the second coupling features cooperates with an engaging surface of the corresponding one of the first coupling features.

In another embodiment, a heat exchanger for a motor vehicle comprises a core and a fluid reservoir. The core includes an open end and a header coupled adjacent to the open end. The header includes a plurality of enclosed cavities. The fluid reservoir includes a plurality of tapered protrusions extending outwardly therefrom. The protrusions of the fluid reservoir are configured to engage the enclosed cavities of the header to secure the fluid reservoir thereto.

In yet another embodiment, a method of assembly of a heat exchanger is disclosed. The method includes providing a fluid reservoir having a plurality of first coupling features, and a header configured to receive a portion of the fluid reservoir therein, the header includes a plurality of second coupling features. The method includes bending the mounting tab of the header outward to present a recess of the header to the sidewall of the fluid reservoir. In another step, the sidewall of the fluid reservoir is inserted into the recess, wherein the sidewall compresses a sealing element disposed within the recess. In a third step, the mounting tab is bent inward, wherein each of the second coupling features cooperates with a portion of a corresponding one of the first coupling features to secure the fluid reservoir to the header.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
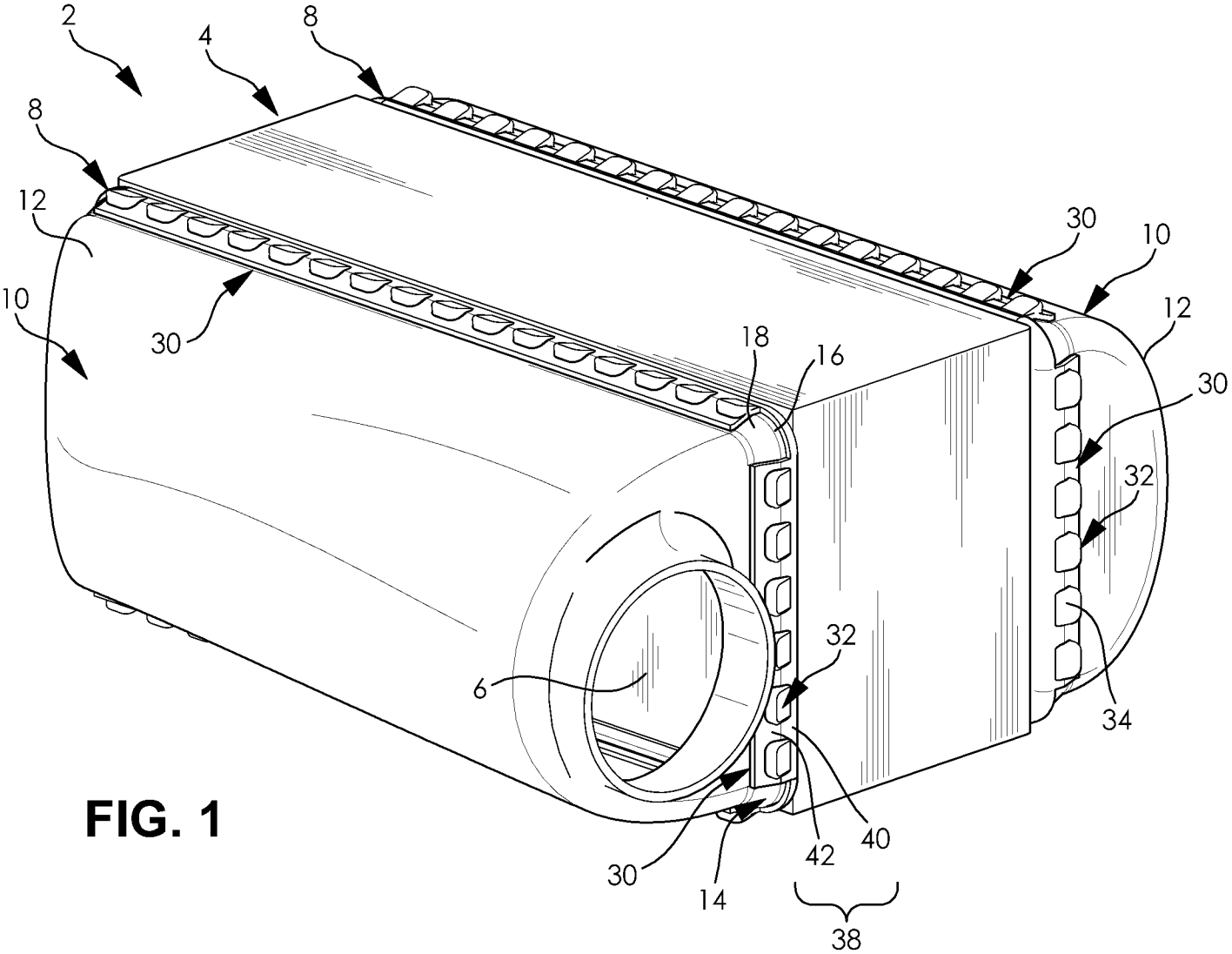
FIG. 1 is a perspective view of a heat exchanger of the instant disclosure.
Figure 2:
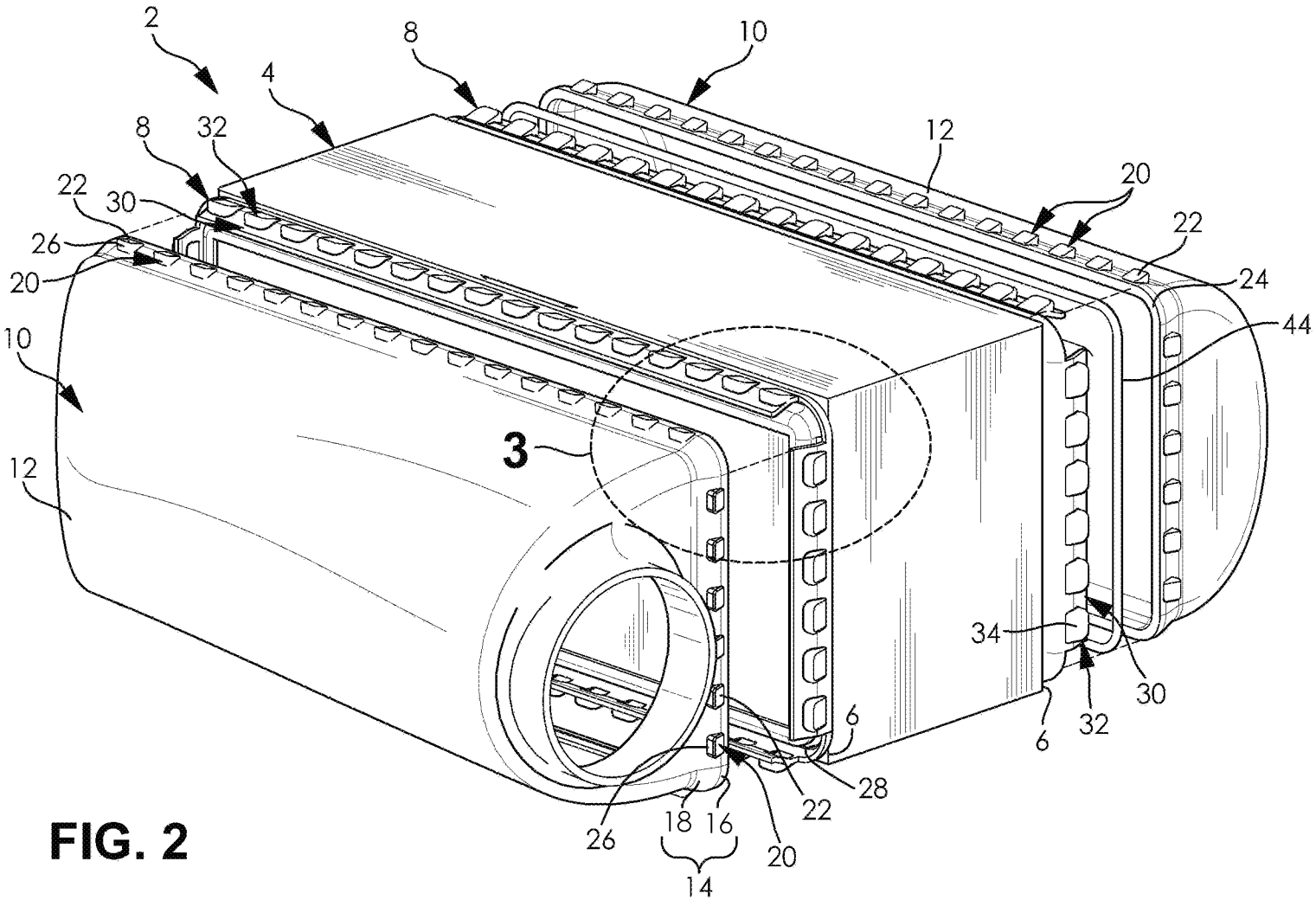
FIG. 2 is a partially exploded perspective view of the assembly of FIG. 1.

FIGS. 1 and 2 show an intake assembly having an integrated heat exchanger 2 according to the instant disclosure. The heat exchanger 2 is formed of a core 4 having a pair of opposing open ends 6. Each of the open ends 6 is configured to provide fluid communication into the heat exchanger 2, wherein fluid enters the heat exchanger 2 through a first one of the open ends 6 and exits the heat exchanger 2 through a second one of the open ends 6. In an alternate embodiment, the heat exchanger 2 may include a single open end 6, wherein fluid enters and exits the heat exchanger 2 through the same open end 6. The heat exchanger 2 further includes a header 8 disposed adjacent each open end 6. The header 8 may be coupled to the heat exchanger 2 using mechanical means, such as welding, crimping, and brazing, for example. Alternatively, the header 8 may be integrally formed with the heat exchanger 2.

As shown in FIG. 1, a fluid reservoir 10 is removably coupled to each of the headers 8 of the heat exchanger 2. In the illustrated embodiment, each of the headers 8 is similarly formed. Accordingly, any description with respect to the configuration of one of the headers 8 and one of the fluid reservoirs 10 will be understood to similarly apply to the other header 8 and fluid reservoir 10. In alternate embodiments, each of the headers 8 may be configured differently than the other.

Referring to FIGS. 1-7, the fluid reservoir 10 includes at least one continuous sidewall 12. A base 14 depends from the sidewall 12 and includes a lip 16 formed adjacent an opening of the fluid reservoir 10, and an intermediate portion 18 connecting the lip 16 and the sidewall 12. In the illustrated embodiment, the lip 16 of the fluid reservoir 10 is outwardly offset from and substantially parallel to a lower portion of the sidewall 12. However, in alternate embodiments, it will be appreciated that the lip 16 may be formed at an oblique angle to the sidewall 12, and that the lip 16 may be aligned with or inwardly offset from the sidewall 12.

A plurality of first coupling features 20 is spaced along the base 14 of the fluid reservoir 10. In the illustrated embodiment, each of the first coupling features 20 is a protrusion extending outward from the base 14 adjacent the lip 16. A distal end 22 of each of the first coupling features 20 tapers outwardly from the fluid reservoir 10, wherein a distance from the distal end 22 to the base 14 increases as a distance from a terminal end 24 of the lip 16 increases. In alternate embodiments, the length of the first coupling feature 20 may be substantially constant.

An engaging surface 26 is formed on each of the first coupling features 20, opposite the terminal end 24 of the lip 16. In one embodiment, each of the engaging surfaces 26 of the first coupling features 20 are coplanar. However, the engaging surfaces 26 of the first coupling features 20 may also be offset from one another.

As shown in FIGS. 4-7, the engaging surfaces 26 are inclined with respect to an axis (A), along which a force is applied to assemble the fluid reservoir 10 to the header 8, wherein a distance from the terminal end 24 to the engaging surface 26 increases as the distance from the base 14 increases. In alternate embodiments, the engaging surface 26 may be formed perpendicular with respect to the axis (A).

Referring again to FIGS. 2-7, the header 8 is configured to cooperate with a portion of the fluid reservoir 10 when the heat exchanger 2 is assembled. Particularly, a recess 28 circumscribes at least a portion of a perimeter of the header 8, and is configured to receive at least a portion of the base 14 of the fluid reservoir 10 therein. In alternate embodiments, a recess may be formed in the fluid reservoir 10, wherein a portion of the header 8 is received therein. It will also be appreciated that both or neither of the fluid reservoir 10 and the header 8 may include a recess. In the illustrated embodiment, a plurality of mounting tabs 30 extend from the recess 28, wherein a single one of the mounting tab 30 spans each of the sides of the header 8. In alternate embodiments, each of the sides of the header 8 may include a plurality of separately formed mounting tabs 30.

Referring again to FIGS. 2 and 3, a plurality of second coupling features 32 is spaced along each of the mounting tabs 30. A position of each of the second coupling features 32 corresponds to a position of a respective one of the first coupling features 20 of the fluid reservoir 10, wherein the second coupling features 32 are configured to engage the first coupling features 20 to secure the fluid reservoir 10 to the header 8. In the illustrated embodiment, each of the second coupling features 32 is an enclosed cavity configured to receive at least a portion of the respective of one of the first coupling features 20. The cavity is defined by a sidewall and an end wall 34.

The sidewall of the cavity defines a receiving surface 36 of the second coupling feature 32, which is configured to cooperate with the engaging surface 26 of the first coupling feature 20. In the illustrated embodiment, the receiving surface 36 is formed opposite the recess 28. As shown in FIGS. 4-7, the receiving surface 36 may be inclined with respect to the recess 28, wherein a distance from the recess 28 to the receiving surface 36 increases as a distance from the axis (A) increases. In an alternate embodiment, the receiving surface 36 may be formed substantially parallel to the recess 28, wherein the receiving surface 36 is perpendicular to the axis (A).

In the illustrated embodiment, a depth of the second coupling features 32 tapers outwardly from the header with respect to the axis (A), wherein a distance between the end wall 34 and the axis (A) increases as a distance from the recess 28 increases. In alternate embodiments, the depth of the second coupling features 32 remains constant with respect to the distance from the recess 28.

Figure 3:
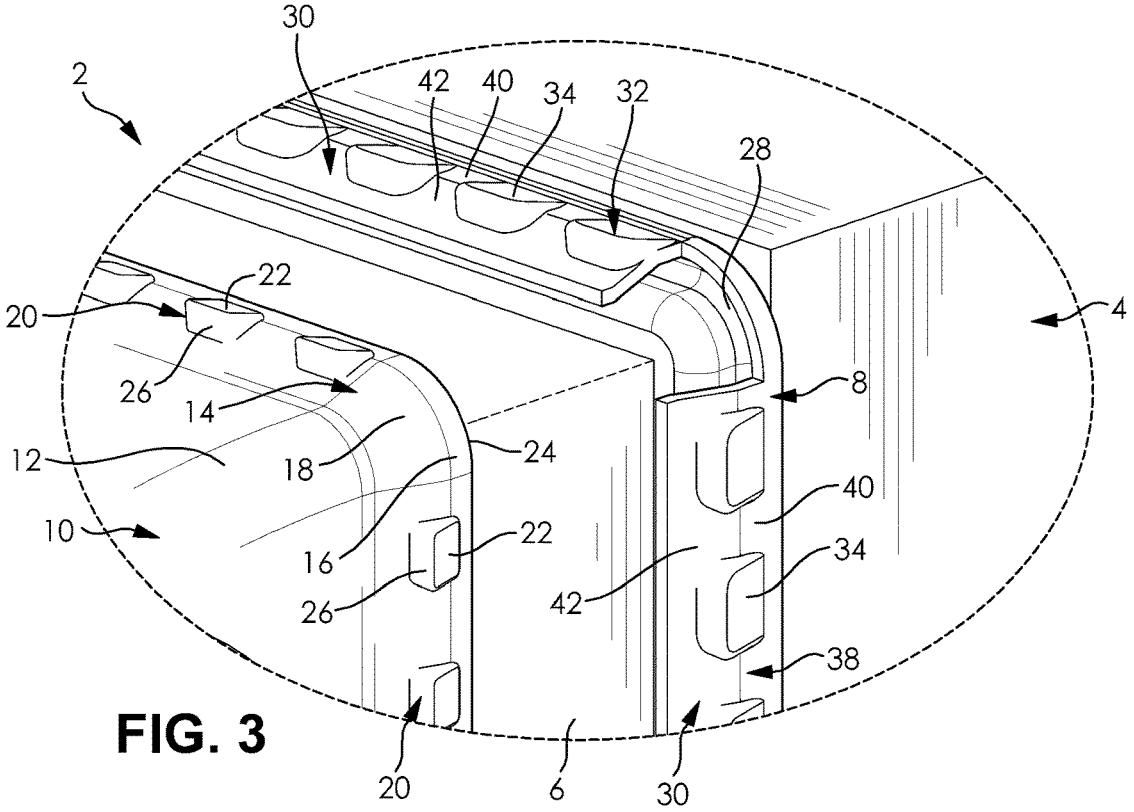
FIG. 3 is an enlarged perspective view of the assembly of FIG. 1, taken at area 3 of FIG. 2.

As shown in FIGS. 2 and 3, a plurality of reinforcement features 38 is formed in each of the mounting tabs 30, intermediate each of the plurality of the second coupling features 32. The reinforcement features 38 are configured to militate against a deflection of the receiving surface 36 of the second coupling features 32 when the compressive force is applied along the axis (A). The reinforcement features 38 are formed of a sidewall 40 extending from the recess 28, and an inwardly formed shoulder 42 extending from the sidewall 40, wherein an inner profile of the mounting tabs 30 is configured to substantially correspond to an outer profile of the base 14 of the fluid reservoir 10.

In an alternate embodiment, a plurality of perforations (not shown) may be formed along a length of each of the mounting tabs 30 to aid in assembly of the fluid reservoir 10 to the header 8. Particularly, the perforations may be formed in the recess 28 and the sidewall 40 of the header 8 to improve flexibility of the mounting tabs 30. It will be appreciated that additional structural features may be added to at least one of the first header 12 and the fluid reservoir 10 to aid in assembly.

A continuously formed sealing element 44 is disposed in the recess 28 of the header 8. In the illustrated embodiment the sealing element 44 is formed separately formed from each of the fluid reservoir 10 and header 8. Optionally, the sealing element 44 may be integrally formed with at least one of the fluid reservoir 10 and header 8. The sealing element 44 is formed of a resilient polymeric material, such as a flouroelastomer (FKM) or an ethylene propylene diene monomer (EPDM). Other suitable materials for the sealing element 44 will be appreciated by those of ordinary skill in the art.

During assembly, the fluid reservoir 10 is secured to the header 8 of the heat exchanger 2 by inserting the base 14 of the fluid reservoir 10 into the recess 28 of the header 12, as shown in FIGS. 4-7.

Figure 4A:
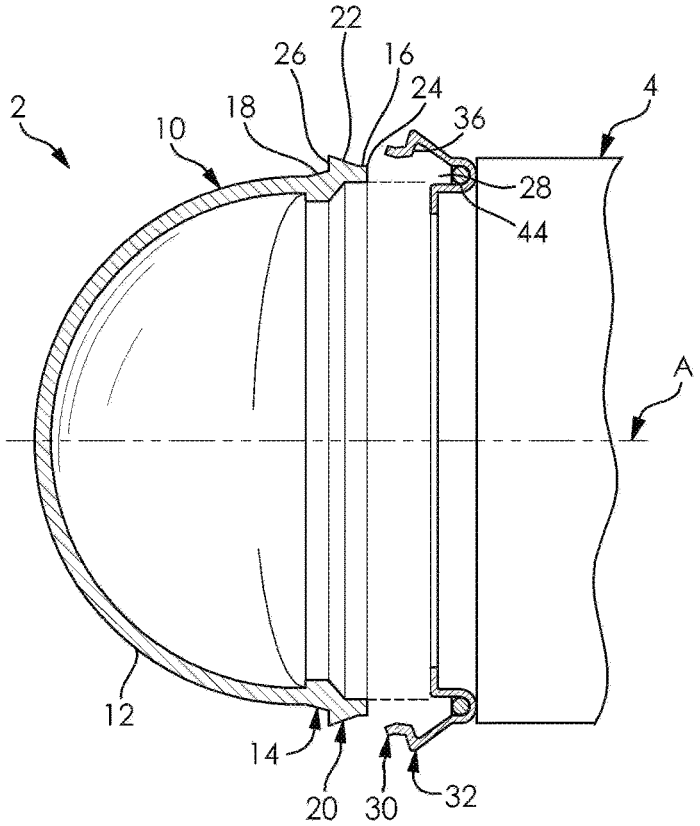
FIG. 4A is a fragmentary schematic cross-sectional elevation view of a first embodiment of the assembly of FIG. 1, wherein the cross-section is taken through a coupling feature of the heat exchanger and the assembly is in a disassembled state.
Figure 4B:
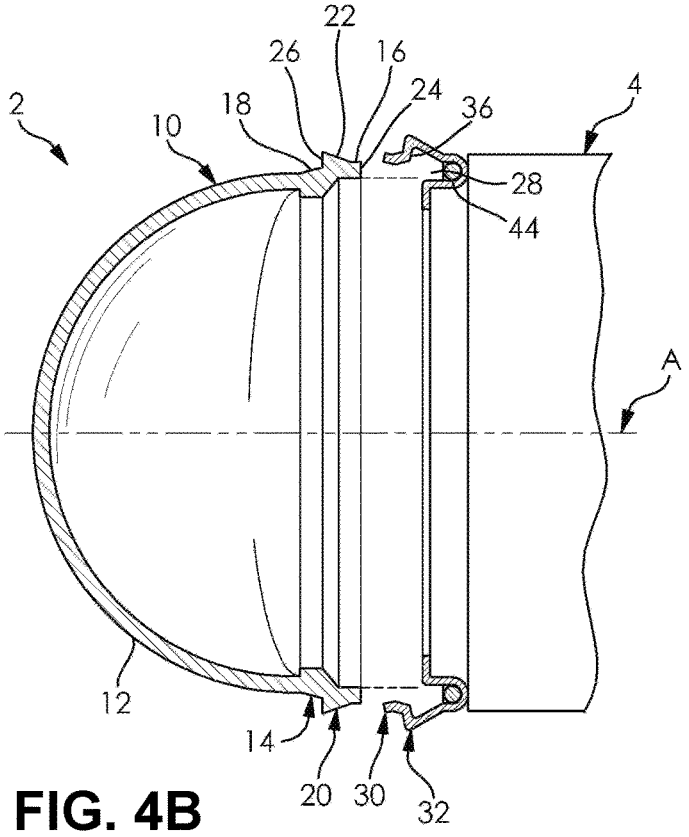
FIG. 4B is a fragmentary schematic cross-sectional elevation view of a second embodiment of the assembly of FIG. 1, wherein the cross-section is taken through a coupling feature of the heat exchanger and the assembly is in a disassembled state.

In a first step, shown in FIGS. 4A and 4B the fluid reservoir 10 is aligned with the header 8, wherein the base 14 of the sidewall 12 is aligned with the recess 28 of the header 8 in a direction along the axis (A).

In a first embodiment of the of the disclosure, shown in FIG. 4A, the mounting tabs 30 are predisposed in an open position with respect to the axis (A). In the open position, the mounting tabs 30 are spread apart from each other such that the base 14 of the fluid reservoir 10 can be received between the mounting tabs 30 unobstructed.

In a second embodiment of the disclosure, shown in FIG. 4B, the mounting tabs 30 are predisposed at an intermediate position with respect to the axis (A). In the intermediate position, the mounting tabs 30 are formed in a partially opened position, wherein the lip 16 of the base 14 can be received inside of the mounting tabs 30, and wherein the distal ends 22 of the first coupling features 20 are formed at least partially outside of the mounting tabs 30.

Although the mounting tabs 30 of the instant disclosure are predisposed in the open position and the intermediate position during stamping or forming of the header 8, it will be appreciated that the mounting tabs 30 may be actively bent to the open position and the intermediate position immediately prior to or during assembly of the heat exchanger 2.

Figure 5:
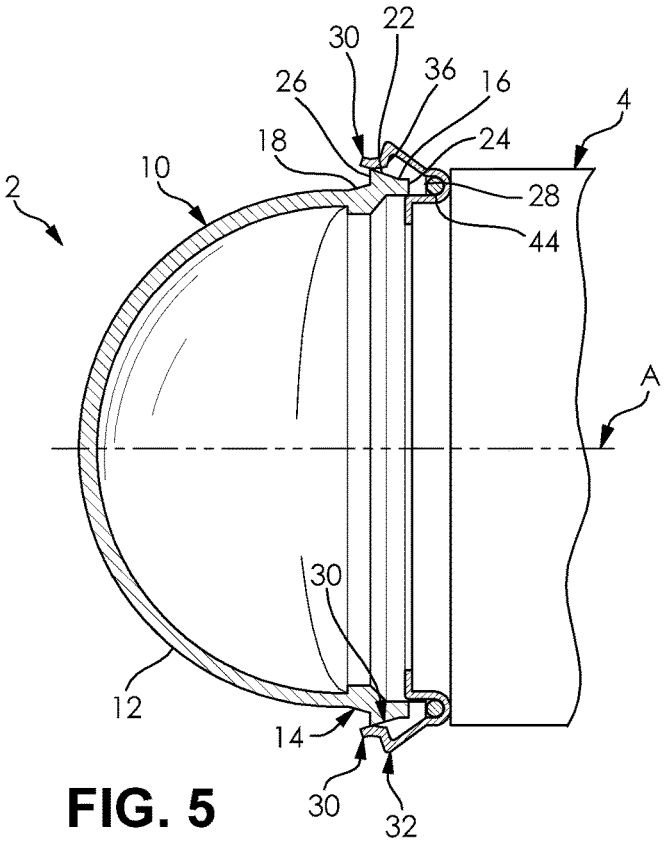
FIG. 5 is a fragmentary schematic cross-sectional elevation view of the assembly of FIG. 1, wherein the cross-section is taken through a coupling feature of the heat exchanger and the assembly is in a partially assembled state.

In a second step, shown in FIG. 5 the fluid reservoir 10 is advanced into the header 8, wherein the base 14 of the fluid reservoir 10 passes through the mounting tabs 30 of the header 8.

As discussed above, in the first embodiment of the disclosure, the mounting tabs 30 are formed in the open position prior to insertion of the base 14. In the second step of the first embodiment, the fluid reservoir 10 is inserted through the mounting tabs 30 unobstructed.

In the second step of the second embodiment, the mounting tabs 30 are biased outward by the base 14 as the base 14 is inserted into the recess 28. As the fluid reservoir 10 is advanced into the header 8, the lip 16 of the base 14 provides a leading edge and passes inside of the shoulder 42 of the mounting tab 30. As the first coupling features 20 progress past the shoulder 42, the outward taper of the distal end 22 of the first coupling feature 20 causes the shoulder 42 and the mounting tab 30 to progressively bend outward, allowing the base 14 of the fluid reservoir 10 to pass.

Figure 6:
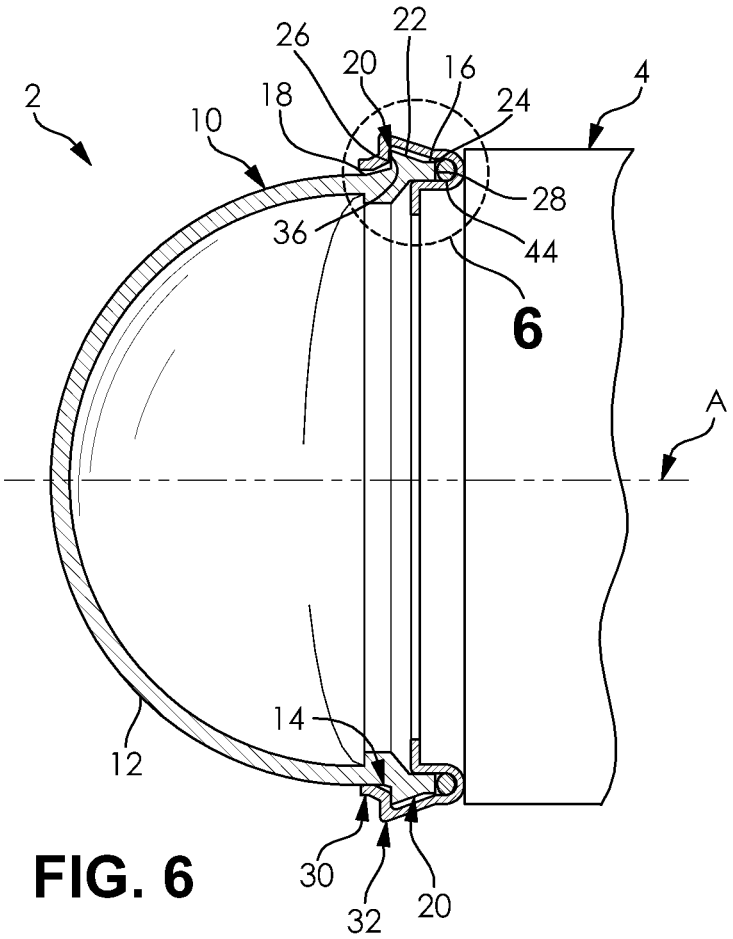
FIG. 6 is a fragmentary schematic cross-sectional elevation view of the assembly of FIG. 1, wherein the cross-section is taken through a coupling feature of the heat exchanger and the assembly is in an assembled state.
Figure 7:
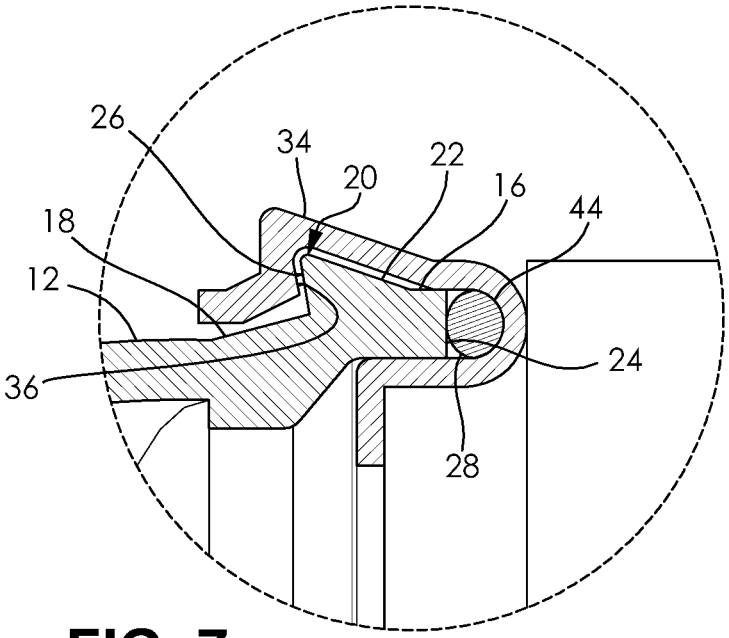
FIG. 7 is an enlarged fragmentary schematic cross-sectional elevation view of the assembly of FIG. 1, taken at area 7 of FIG. 6.

As the lip 16 of the fluid reservoir 10 is received in the recess 28, the sealing element 44 is compressed by the terminal end 24 of the lip 16 to form a fluid seal between the fluid reservoir 10 and the first header 12, as shown in FIGS. 6 and 7. With the sealing element 44 compressed in the recess 28, the first coupling features 20 are aligned with second coupling features 32, and the mounting tabs 30 are bent inwards, wherein the first coupling features 20 of the fluid reservoir 10 are received in the second coupling features 32 of the header 8. In one embodiment, an elastic force of the mounting tab 30 may cause the mounting tab 30 to spring inwardly to a closed position when the base 14 is positioned within the recess 28. In the second embodiment described hereinabove, the mounting tabs 30 are bent inwards manually after the base 14 is positioned within the recess 28. It will be understood that a combination of the elastic force and manual bending may be utilized to move the mounting tabs 30 to the closed position.

In the closed position, shown in FIGS. 6 and 7, the engaging surfaces 26 of the first coupling features 20 cooperate with the receiving surfaces 36 of the second coupling features 32 to secure the base 14 of the fluid reservoir 10 from the recess 28 of the header 8, and to maintain the compressive force on the sealing element 44. Accordingly, the first coupling feature 20 is compressed against the second coupling feature 32. As shown in FIGS. 6 and 7, when each of the engaging surfaces 26 and each of the receiving surfaces 36 are inclined, the compressive force causes the receiving surfaces 36 of the second coupling features 32 to be biased inward by the engaging surfaces 26 of the first coupling features 20, further securing the fluid reservoir 10 by preventing the mounting tab 30 from bending outward.

By forming the coupling features 28, 40 of the heat exchanger 2 according to the disclosure, the strength and durability of the heat exchanger 2 are significantly increased over the prior art. Particularly, by forming each of the second coupling features 32 of the enclosed cavity having the receiving surface 36, stress concentrations imparted on the headers are minimized by distributing the stresses over the entirety of the second coupling features 32.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A heat exchanger for a motor vehicle, the heat exchanger comprising:

a fluid reservoir having a plurality of first coupling features; and a header including a plurality of second coupling features and a plurality of reinforcing features formed intermediate adjacent ones of the second coupling features, the second coupling features configured to engage the first coupling features, wherein each of the reinforcing features is formed of a sidewall and a shoulder, wherein the sidewall of each of the reinforcing features spans a distance between the adjacent ones of the second coupling features and wherein the shoulder of each of the reinforcing features spans the distance between the adjacent ones of the second coupling features, wherein the shoulder of each of the reinforcing features is inwardly inclined relative to the corresponding sidewall of each of the reinforcing features, wherein each of the second coupling features are enclosed cavities formed from an end wall and a sidewall, and wherein each of the second coupling features have a triangular cross sectional shape.

2. The heat exchanger of claim 1, wherein the first coupling features are protrusions.

3. The heat exchanger of claim 2, wherein the cavities are configured to receive the protrusions.

4. The heat exchanger of claim 1, wherein the heat exchanger is configured to receive a portion of the fluid reservoir therein.

5. The heat exchanger of claim 4, wherein the header includes a recess circumscribing a perimeter of the header.

6. The heat exchanger of claim 5, wherein a plurality of mounting tabs extends from the recess.

7. The heat exchanger of claim 6, wherein the second coupling features are formed in the mounting tabs.

8. The heat exchanger of claim 1, wherein each of the first coupling features includes an engaging surface and each of the second coupling features includes a receiving surface, and wherein the engaging surface is configured to cooperate with the receiving surface to secure the fluid reservoir to the header.

9. The heat exchanger of claim 8, wherein the engaging surface of each of the first coupling features and the receiving surface of each of the second coupling features are inclined.

10. A heat exchanger for a motor vehicle, the heat exchanger comprising:

a core having an open end;

a header coupled to the core adjacent the open end, the header including a plurality of cavities, wherein each of the cavities is defined by a concave portion of an inner surface of the header; and a fluid reservoir including a sidewall having an outer surface, a base, and a terminal end depending from the base and defining an opening of the fluid reservoir, the fluid reservoir including a plurality of protrusions extending outwardly from the outer surface thereof, wherein each of the protrusions is defined by a convex portion of an outer surface of the fluid reservoir, wherein each of the protrusions is received in and enclosed by one of the cavities of the header, and wherein each of the cavities has a shape corresponding to a shape of one of the protrusions received therein, wherein a lip is formed on the sidewall adjacent the terminal end of the fluid reservoir and is outwardly offset from and parallel to a lower portion of the sidewall, wherein each of the protrusions includes an engaging surface and the inner surface forming the concave portion of the inner surface of the header includes a receiving surface engaging the engaging surface, wherein each of the engaging surfaces is formed opposite the terminal end, wherein each of the engaging surfaces is inclined with respect to an axis along which a force is applied to assemble the fluid reservoir to the header, wherein a distance from the terminal end to each of the engaging surfaces increases as the distance from the base increases.

11. The heat exchanger of claim 10, wherein the cavities are formed on a mounting tab of the header.

12. The heat exchanger of claim 10, wherein the protrusions are formed on the base of the fluid reservoir.

13. The heat exchanger of claim 10, wherein a distal end of each of the protrusions is tapered outwardly.

* * * * *